US009969594B2

(12) United States Patent
Hut et al.

(10) Patent No.: US 9,969,594 B2
(45) Date of Patent: May 15, 2018

(54) DEVICE FOR RETRACTING A HOSE, AND VEHICLE AND METHOD THEREFOR

(71) Applicant: HYTRANS BEHEER B.V., Lemmer (NL)

(72) Inventors: Robert Dirk Hut, Wergea (NL); Appie Veenema, Rottum (NL)

(73) Assignee: HYTRANS BEHEER B.V., Lemmer (NL)

( * ) Notice: Subject to any disclaimer, the term of this patent is extended or adjusted under 35 U.S.C. 154(b) by 192 days.

(21) Appl. No.: 14/365,044

(22) PCT Filed: Dec. 13, 2012

(86) PCT No.: PCT/NL2012/050884
§ 371 (c)(1),
(2) Date: Jun. 12, 2014

(87) PCT Pub. No.: WO2013/095116
PCT Pub. Date: Jun. 27, 2013

(65) Prior Publication Data

US 2015/0041515 A1 Feb. 12, 2015

(30) Foreign Application Priority Data

Dec. 13, 2011 (NL) ..... 2007956

(51) Int. Cl.
*B65H 51/32* (2006.01)
*A62C 33/04* (2006.01)
*A62C 33/02* (2006.01)

(52) U.S. Cl.
CPC ..... *B65H 51/32* (2013.01); *A62C 33/02* (2013.01); *A62C 33/04* (2013.01)

(58) Field of Classification Search
CPC ..... A62C 33/02; A62C 33/00; A62C 33/04; B65H 20/02; B65H 51/10;
(Continued)

(56) References Cited

U.S. PATENT DOCUMENTS 3,733,799 A * 5/1973 Roethke ..... B65H 51/10 57/263
3,866,532 A * 2/1975 Ogden, Jr. ..... A62C 33/02 100/100

(Continued)

FOREIGN PATENT DOCUMENTS

CN 201361392 Y 12/2009
EP 0631796 A1 1/1995

OTHER PUBLICATIONS

International Search Report and Written Opinion dated Jun. 10, 2013 (PCT/NL2012/050884); ISA/EP.

(Continued)

*Primary Examiner* — Glenn F Myers
(74) *Attorney, Agent, or Firm* — Shay Glenn LLP

(57) ABSTRACT

A retracting device and method for retracting a hose, the device comprising:
- a frame;
- at least one drive roller connected to the frame for driving the hose for retraction;
- a first and a second pressing element operatively connected to the at least one drive roller and suitable for pulling the hose upward in co-action with the at least one drive roller;
- an activating element operatively connected to the two pressing elements and suitable for activating the pressing elements such that no more than one pressing element presses against the drive roller.

21 Claims, 8 Drawing Sheets

(58) Field of Classification Search
CPC .. B65H 2301/5115; B65H 2301/41462; B65H 2301/4474; B65H 2701/33; B65H 2701/332; B65H 2404/422; B65H 2404/7231; B65H 51/32; B65H 51/00; B65H 29/12; B65H 75/34; B65H 75/36; B65H 75/42; B65H 75/425; B65H 75/4449; B65H 75/441; B65H 75/4402; B08B 3/022; B08B 3/04; B60P 3/00; B60P 3/035; B60P 7/00; A61G 15/18
See application file for complete search history.

(56) References Cited

U.S. PATENT DOCUMENTS

| | | | | |
|---|---|---|---|---|
| 4,452,135 | A | 6/1984 | Hayes | |
| 5,040,259 | A * | 8/1991 | Ishii | A62C 33/02 134/113 |
| 8,168,007 | B1 * | 5/2012 | Riha | A62C 33/02 134/64 R |
| 9,399,560 | B2 * | 7/2016 | Baker | F16L 1/065 |
| 2003/0230210 | A1 * | 12/2003 | Porat | B41F 7/02 101/486 |
| 2005/0011979 | A1 * | 1/2005 | Best | A62C 33/02 242/370 |

OTHER PUBLICATIONS

Dutch Patent Office International-Type Search Report dated Jul. 10, 2012 (NL2007956); ISA/EP.

* cited by examiner

DEVICE FOR RETRACTING A HOSE, AND VEHICLE AND METHOD THEREFOR

CROSS REFERENCE TO RELATED APPLICATIONS

The present application is a U.S. National Phase filing of International Application No. PCT/NL2012/050884, filed on Dec. 13, 2012, designating the United States of America and claiming priority to Dutch Patent Application No. NL 2007956, filed Dec. 13, 2011. The present application claims priority to and the benefit of all the above-identified applications, and all the above-identified applications are incorporated by reference herein in their entireties.

FIELD

The present invention relates to a retracting device for retracting a hose. Such a hose is for instance a liquid hose, and more particularly a fire hose. After use these hoses are retracted with the retracting device according to the invention.

BACKGROUND

Known devices for retracting a flexible hose comprise at least a number of pinch elements for retracting the hose. A fairly complex mechanism is necessary to be able to deal with hose couplings while using such pinch elements. In addition to the complexity, drawbacks hereof are the cost and maintenance of such a device. Such a device is for instance described in NL 9301097.

SUMMARY

The present invention has for its object to provide an improved retracting device with which the above stated drawbacks are obviated or at least reduced.

This objective is achieved with a retracting device for retracting a hose according to the invention, the retracting device comprising:

- a frame;
- at least one drive roller connected to the frame for driving the hose for retraction;
- a first and a second pressing element operatively connected to the at least one drive roller and suitable for pulling the hose upward in co-action with the at least one drive roller; and
- an activating element operatively connected to the two pressing elements and suitable for activating the pressing elements such that no more than one pressing element presses against the drive roller.

BRIEF DESCRIPTION OF THE DRAWINGS

Further advantages, features and details of the invention are elucidated on the basis of preferred embodiments thereof, wherein reference is made to the accompanying drawings, in which.

DETAILED DESCRIPTION

Figure 1:
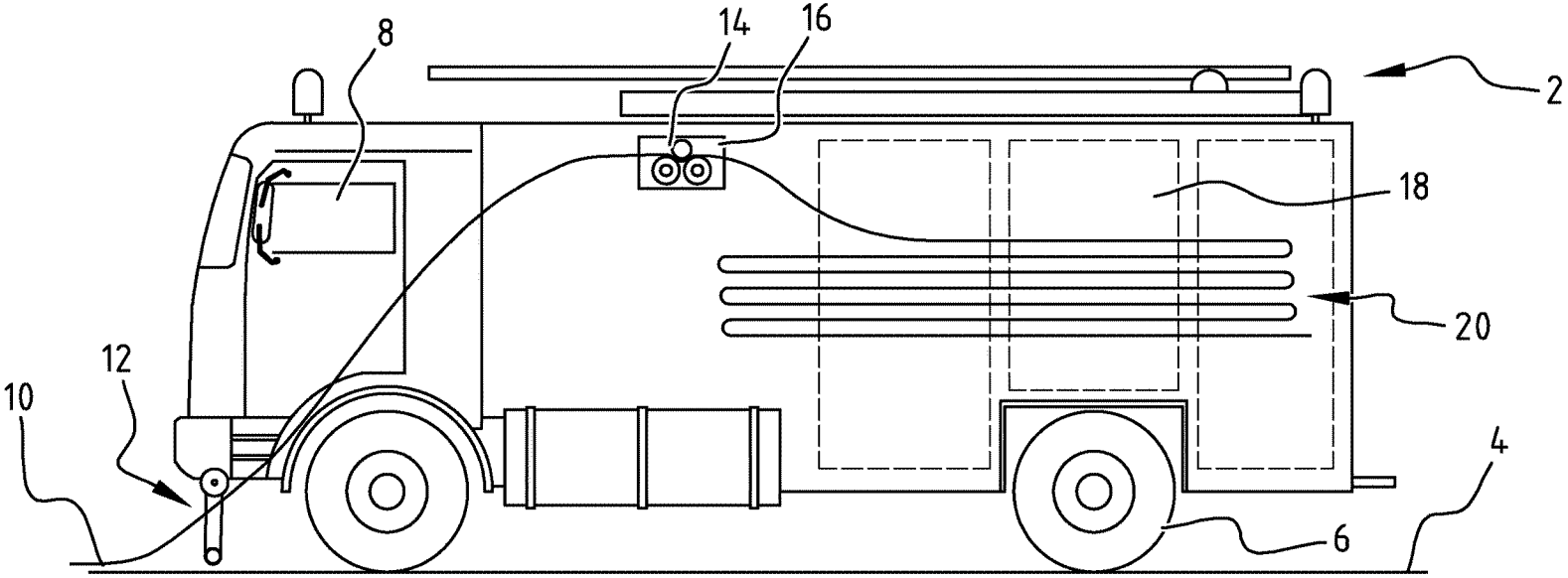
FIG. 1 shows a view of a vehicle provided with the retracting device according to the invention.

A retracting device for retracting a hose is provided. According to various embodiments, the retracting device comprises:

- a frame;
- at least one drive roller connected to the frame for driving the hose for retraction;
- a first and a second pressing element operatively connected to the at least one drive roller and suitable for pulling the hose upward in co-action with the at least one drive roller; and
- an activating element operatively connected to the two pressing elements and suitable for activating the pressing elements such that no more than one pressing element presses against the drive roller.

The retracting device according to the invention serves to retract a hose, in particular a liquid hose, which is also understood to mean a fire hose. Such fire hoses consist of hose parts mutually connected with hose couplings.

Providing a drive roller makes it possible to drive, and thereby retract, the hose to be retracted. This avoids the necessity of manual pulling on the hose for retraction. In the case of a fire hose, these hoses are usually wholly or partially filled with water following use, so that these hoses have a substantial weight and the drive forces required are not inconsiderable.

The drive roller according to the invention comprises a preferably cylindrical element over which the hose for retraction is guided. By driving the drive roller with a motor a force is exerted on the hose, which is thereby retracted. This retraction relates to the picking up and lifting of the hose. As soon as the start of the hose has been carried over the drive roller, this roller has a driving and thereby retracting effect on the hose.

In order to prevent a hose coupling between two hose parts impeding the retraction, the drive roller preferably makes use of said cylindrical roller element. The contact between the coupling and the drive roller hereby remains limited to a very short period of time since the hose is in motion and moves over the preferably cylindrical drive roller. The hose coupling will therefore come into contact with the drive roller for only a brief moment. Because the drive roller is positioned above a ground surface on which the hose for retraction is located, and downstream of the drive roller the hose is positioned downward in a container or other space, the hose coupling will as it were drop over the drive roller. This prevents the hose coupling possibly falling back to the ground surface and thereby impeding or even blocking the retraction.

The device according to the invention further comprises at least a first and second pressing element which are operatively connectable to the at least one drive roller. A pressing element is suitable for pulling the hose upward together with the at least one drive roller such that, with the assistance of gravitational force, the liquid runs out of the hose. The pressing element presses for this purpose against the drive roller with the hose for retraction therebetween. Liquid still present in the hose during retraction at the position of the retracting device according to the invention is in this way pulled upward by the co-action of a pressing element and the drive roller, and thereby emptied.

The at least two pressing elements are operatively connected by providing an activating element. The activating element activates the pressing elements such that no more than one pressing element presses against the drive roller. During use the first pressing element can press here at a first position against the drive roller and the second pressing element can press at a second, different, position against the drive roller. It is hereby possible to feed hose couplings through in simple manner without the couplings for instance becoming jammed between the pressing elements in contact with the drive roller.

As soon as a hose coupling arrives at the first position, the first pressing element will be deactivated so that the coupling can pass this first position. After the co-action between drive roller and pressing element has ended, the second pressing element is activated in order to pull the hose upward and enable emptying thereof during the whole process. As soon as the hose coupling arrives at the second position, the second pressing element will be uncoupled from the drive roller and the first pressing element will then once again take over the upward pulling function together with the drive roller. It is possible in this way to retract hose couplings as component of a hose in simple and automatic manner.

An effective device is realized by embodying the activating element such that no more than one pressing element presses against the drive roller, with the hose for retraction therebetween, since malfunctions, jamming or misalignment of the hose relative to the device are prevented from occurring. It has been found that the number of malfunctions of this kind are hereby reduced. The activating element can take software form as well as mechanical form. In a software embodiment the movement of the first pressing element is used to activate the movement of the second pressing element, or vice versa. In the case of an activating element in mechanical form use is for instance made of a rod mechanism with which it is possible to coordinate the relative movement of the two pressing elements in relation to the drive roller. This relates expressly to the relative movement of the pressing elements in relation to the drive roller.

In a currently preferred embodiment according to the present invention it is possible to retract and carry the hose into the loading space of the vehicle from the front side, or in the direction of travel of the vehicle, as well as from the rear side, or in opposite direction to the usual direction of travel of the vehicle.

The pressing elements are preferably embodied as rollers or other roller-like elements. By making use of a cylindrical roller element, preferably of the same size as the drive roller as seen in length direction thereof, a hose for retraction can be pulled upward over the whole width thereof. The shafts of the individual pressing rollers and the drive roller lie substantially parallel to each other here. The relative movement of drive rollers and pressing rollers substantially takes place in a plane substantially perpendicular to these shafts.

In an advantageous preferred embodiment according to the present invention the drive roller is provided with displacing means for displacing the drive roller relative to the pressing elements.

Providing displacing means for a drive roller enables relative displacement of the drive roller in relation to the pressing elements, wherein in a currently preferred embodiment the drive roller performs the movement. It can in this way suffice to move a drive roller, and the pressing elements or pressing rollers can remain in the same position.

Additionally or alternatively to the displacing drive roller, the pressing elements can be displaced using displacing means. This achieves that the pressing elements, particularly pressing rollers, are moved in order to thereby realize the relative displacement in relation to the drive roller.

The displacing means comprise rotation and/or translation mechanisms. In the case of a rotation mechanism the drive roller is rotated and/or the pressing elements are rotated around a shaft using a rod or rod mechanism. In the case of a translation mechanism, guides are provided for moving the drive roller and/or pressing elements. It is also possible to provide both a rotation and a translation mechanism for the purpose of realizing a combined movement.

In an advantageous preferred embodiment according to the present invention the displacing means displace the drive roller and/or pressing elements such that they carry along a moving hose coupling.

Activation of the displacing means as soon as a hose coupling reaches the first and/or second position achieves that the hose coupling is as it were given an extra impetus so that it is thereby as it were pushed over the drive roller during the movement of the pressing elements relative to the drive roller. Alternatively or additionally, in the case of a displacing drive roller, this roller is as it were pressed through under a hose coupling such that the coupling will not drop back. These are ways of further preventing the hose coupling from dropping back in the direction of the ground surface on which the hose for retraction is lying.

In a further advantageous preferred embodiment according to the present invention the device comprises a detector for detecting a hose coupling.

Providing the device with a detector makes it possible to determine that a hose coupling is approaching or has just reached a specific position, for instance said first position. At that moment the displacement of the drive roller and/or pressing elements can be initiated using the activating mechanism. The speed of retraction hereby remains as constant as possible, thereby achieving that a hose coupling which may be present causes no disruption during retraction.

In a further advantageous preferred embodiment according to the present invention the device further comprises guide means for displacing the retracting device over or along a guide.

Providing a guide makes it possible to displace the retracting device according to the invention with the guide means of the retracting device. The retracting device is preferably displaced here in or over a length direction or width direction of the space in which the retracted hose is positioned. The hose can in this way be set down correctly. The retracting device is provided here with a drive device which provides for the movement of this retracting device. This movement can for instance be performed using a battery as energy source, which drives runners which run over a guide placed substantially in a length direction of the space in which the hose is positioned.

In a further advantageous preferred embodiment according to the present invention the guide means comprise a guide roller extending substantially in width direction of the retracting device, and a guide rail for moving the retracting device in length direction thereof.

The guide rail enables a movement of the retracting device in at least the length direction of the vehicle. The retracted hose is hereby positioned in effective manner in the loading space of the vehicle. The guide rail preferably also enables movement in width direction of the vehicle, i.e.

movement of the whole or part of the retracting device is possible in an x-y plane. The retracted hose can hereby be spread over the whole surface of the loading space in effective manner, preferably in automatic manner, without requiring manual labour.

The guide roller makes it possible to lift a hose for retraction over for instance a front wall of the loading space and to prevent for instance hose couplings dropping back to the road surface during retraction.

The drive roller and pressing elements can be arranged at the position of the guide roller, or even form this guide roller. The drive roller and pressing elements can also move via the guide rail, preferably in the x-y plane. It is also possible to provide what are in fact two drive rollers with associated pressing elements, the first of which functions on the front side as guide roller and the second of which functions to position the retracted hose in the loading space.

In a further advantageous preferred embodiment according to the present invention the retracting device is provided at an angle to a horizontal plane.

By providing the retracting device at an angle to a horizontal plane, for instance the road surface over which a vehicle provided with the retracting device is moving, the retraction forces are better directed in the direction of movement of the hose during retraction. The angle, also referred to as the retraction angle, is preferably such that the retracting device is oriented substantially in line with the direction of movement of the hose just in front of the retracting device. This will amount in practice to an angle in the range of for instance 30-70 degrees, depending on the dimensioning of the retracting device and/or the vehicle provided therewith.

The invention further relates to a vehicle provided with a retracting device as stated above.

Such a vehicle provides the same effects and advantages as stated in respect of the retracting device. Such a vehicle is particularly a fire engine vehicle with which a used hose is retracted and thereby cleared away after use. This vehicle is preferably provided with a space in which the hose can be positioned, for instance a loading space. In a possible embodiment, the vehicle is provided with a guide along which the retracting device can be displaced. The retracting device is provided for this purpose with a drive, wherein use is for instance made of the battery of the vehicle.

In a further advantageous preferred embodiment according to the present invention the vehicle further comprises a loading space for retracting the hose from the rear side.

Retraction from the front has the advantage that the hose is taken up without the hose and couplings sliding a great deal over the road surface, so causing less wear. In addition, the driver of the vehicle has a relatively good view of the hose retracting process. In this embodiment the hose does however have to be lifted relatively high over the front wall of the loading space and, because of the return stroke of the retracting device, a buffering of the hose is necessary.

Retraction from the rear has the advantage that this can take place via the "door opening" of the loading space, therefore at less height. A hose buffering takes place automatically on the road surface during the return stroke. A lifting provision is optionally provided for the purpose of lifting the hose for retraction such that the water runs out of the hose for retraction.

The invention further also relates to a method for retracting a hose, comprising of:

providing a retracting device as discussed above; and retracting the hose with the retracting device.

Such a method provides the same effects and advantages as stated in respect of the retracting device and/or the vehicle.

If desired, the hose can preferably be retracted from the front side, or in the direction of travel of the vehicle, as well as from the rear side, or in opposite direction to the usual direction of travel of the vehicle, and be carried into the loading space of the vehicle as described above in respect of the vehicle.

A vehicle 2 (FIG. 1) is displaced over a ground surface 4 by means of wheels 6. Vehicle 2 has a cab 8 in which a driver can sit. Hose 10 is guided via a guide 12 to retracting device 14 with frame 16. The retracted hose 10 is carried by retracting device 14 into a storage space or loading space 18 in which lies a stack 20 of the retracted hose 10.

A first embodiment of retracting device 22 (FIGS. 2A and B) comprises a drive roller 24 with drive shaft 26, with which hose 10 is retracted in the direction of arrow A. Hose 10 consists here of a number of hose parts 28 mutually connected by a coupling 30. Drive roller 24 is driven in rotation direction B by means of a motor (not shown).

In the shown embodiment device 22 is further provided with a first pressing roller 32 with rotation shaft 34 and a second pressing roller 36 with second rotation shaft 38. In the shown embodiment (FIG. 2A) the first pressing roller 32 presses hose 10 against drive roller 24, wherein drive roller 24 is rotated in the direction of arrow B. Second pressing roller 36 lies clear of hose 10. In the shown embodiment drive roller 24 is connected with rod 40 to rotation shaft 42. Drive roller 24 can perform a rotating movement in direction C around rotation shaft 42. In the shown embodiment drive rollers 32, 36 are disposed fixedly.

Figure 2A:
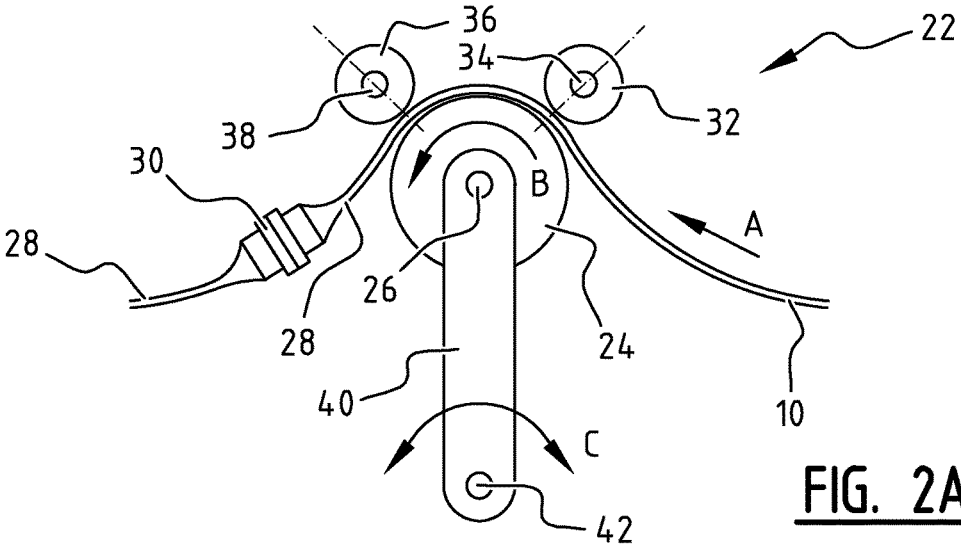
FIGS. 2A and B show a view of a first embodiment of the retracting device according to the invention.
Figure 2B:
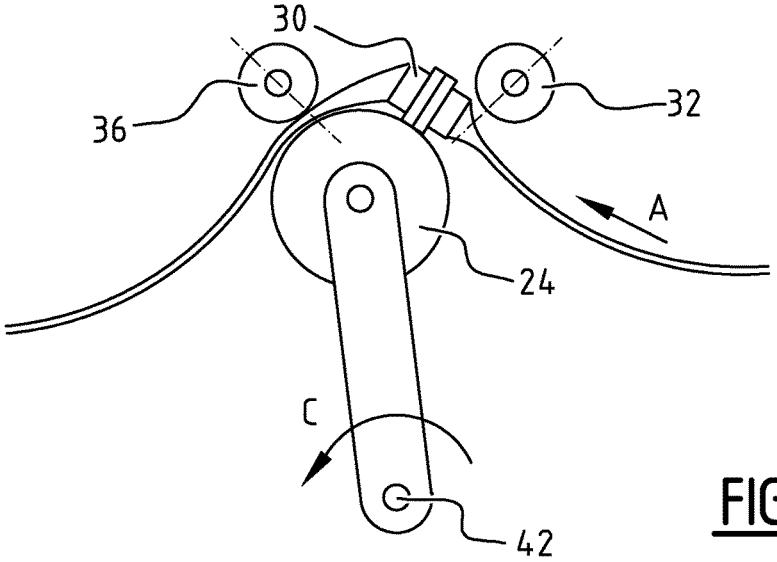

When a hose coupling 30 approaches first pressing roller 32, in the shown embodiment drive roller 24 will be moved away toward second pressing roller 36 (FIG. 2B). The movement of pressing roller 24 around shaft 42 takes place using a drive (not shown) or by making use of a spring force, wherein coupling 30 presses drive roller 24 against pressing roller 36 counter to the action of this spring force. As soon as coupling 30 has passed the first position at first pressing roller 32, the arrival of coupling 30 at the second position at pressing roller 36 will move drive roller 24 back to the first position as shown in FIG. 2A.

Figure 3:
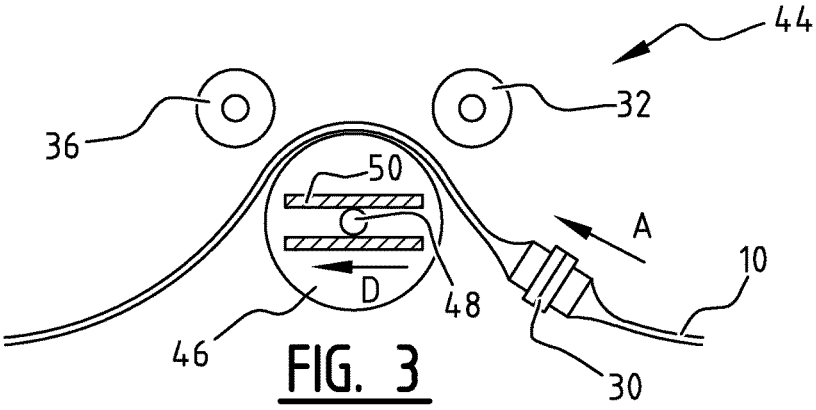
FIG. 3 shows a view of a second embodiment.

In an alternative embodiment device 44 (FIG. 3) is provided with first and second pressing rollers 32, 36 and a drive roller 46 is provided which, in the shown embodiment, is displaceable substantially horizontally in direction D. In the shown embodiment drive roller 46 with shaft 48 is guided via guide 50. Drive roller 46 can further be displaced in the same manner as drive roller 24, i.e. making use of a separate drive or of the force with which coupling 30 pushes against a spring element.

Figure 4A:
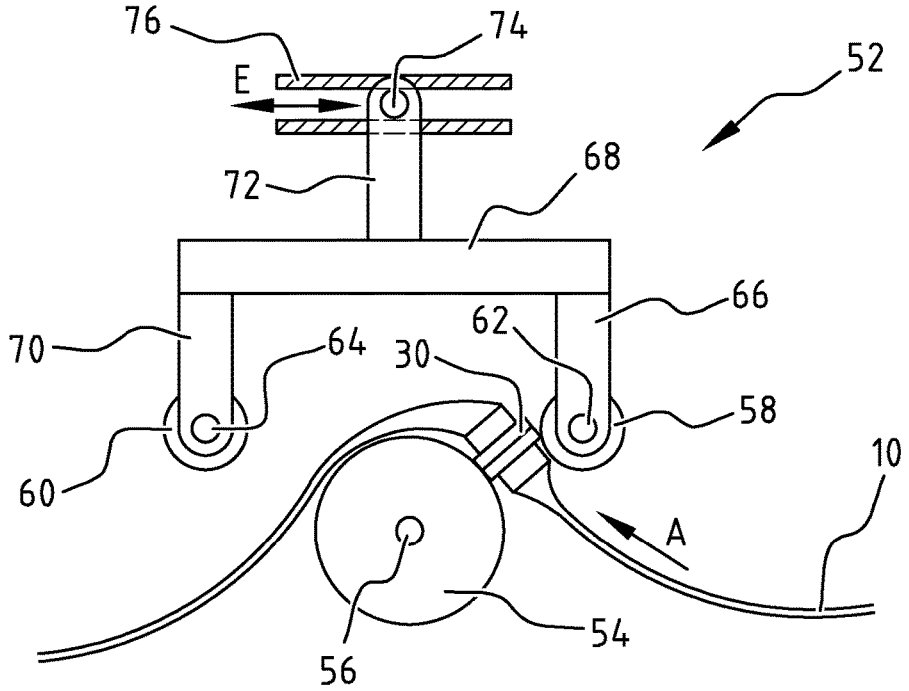
FIGS. 4A and B show views of further embodiments according to the invention.

In a further alternative embodiment retracting device 52 is provided with a fixedly disposed drive roller 54 which rotates around shaft 56 (FIGS. 4A and B). First and second pressing rollers 58, 60 are provided rotatably around respective shafts 62 and 64. Using rods 66, 68, 70 and 72 the pressing rollers 58, 60 are mutually connected and can be displaced together.

In the shown embodiment the displacement of pressing rollers 50, 60 (FIG. 4A) is realized by displacing rollers 58, 60 in a direction E with rod mechanism 66, 68, 70 and 72 using shaft 74 and guides 76. This displacement can once again be performed here with a separate drive, as well as by using a spring force.

Figure 4B:
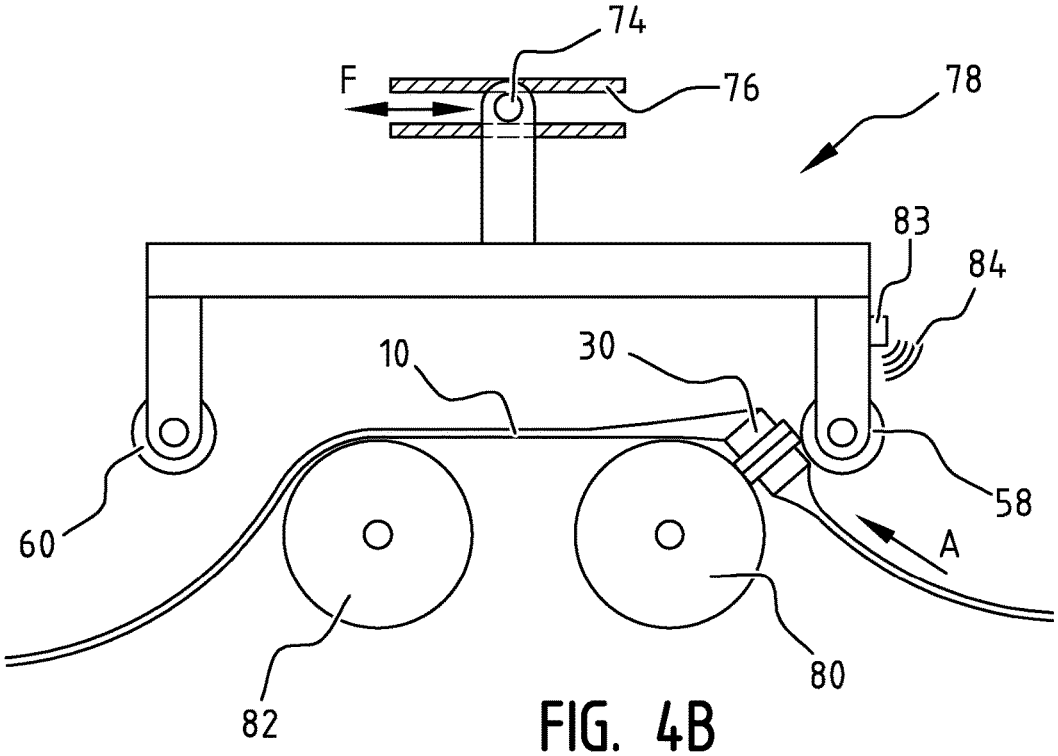

In an alternative embodiment device 78 is provided with a first drive roller 80 and a second drive roller 82 (FIG. 4B). The further operation is the same as the operation of device 42 (FIG. 4A).

Device 78 is further provided with a detector 83 with which a signal 84 can be generated for the purpose of detecting a coupling 30. An approaching coupling 30 can hereby be detected such that pressing rollers 58 and drive rollers 80, 82 can be positioned relative to each other. Detector 83, which makes use of a signal 84, can also be applied on the other shown embodiments of the device 14, 22, 44 and 52.

Figure 5:
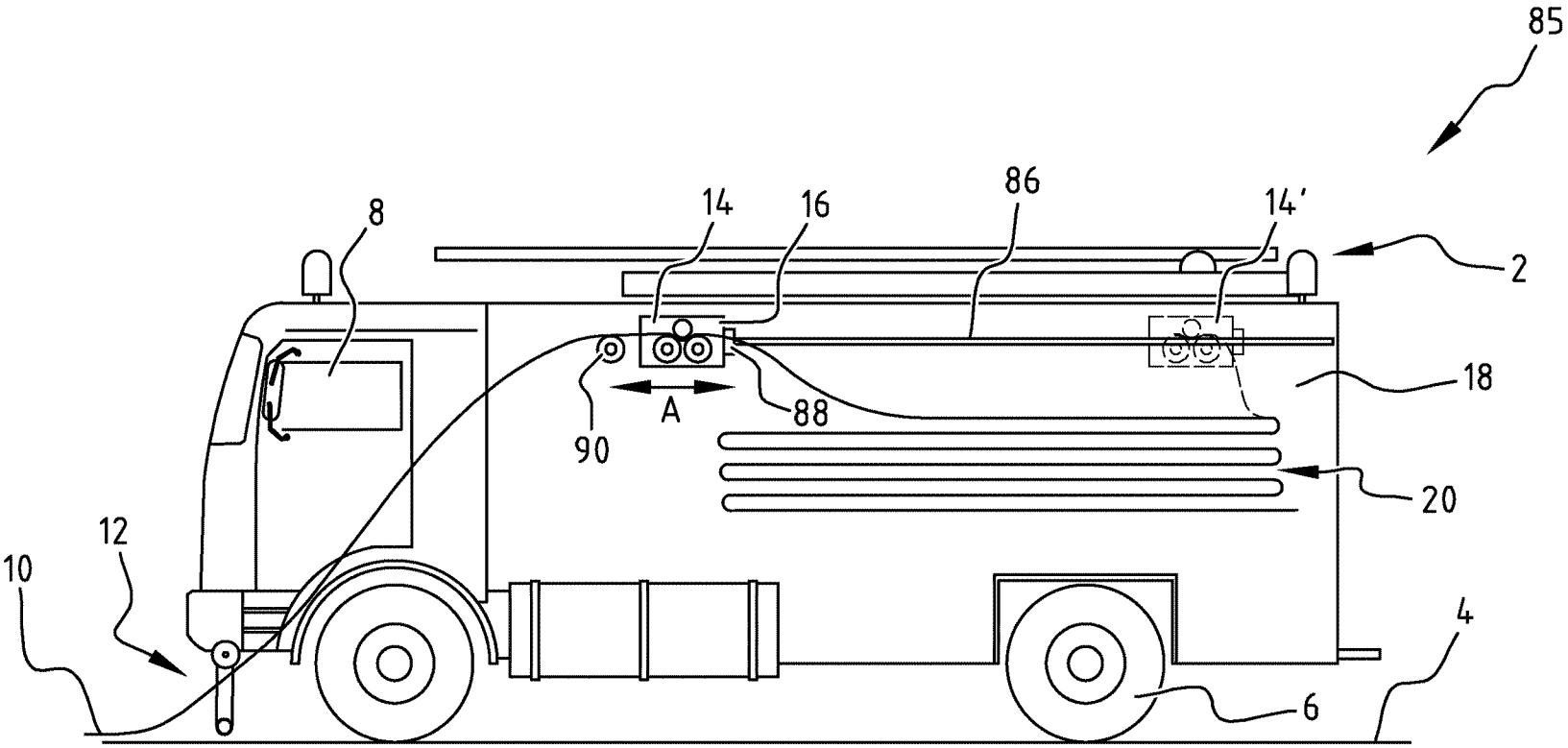
FIG. 5 shows a view of a vehicle provided with a displaceable retracting device according to the invention.
Figure 6:
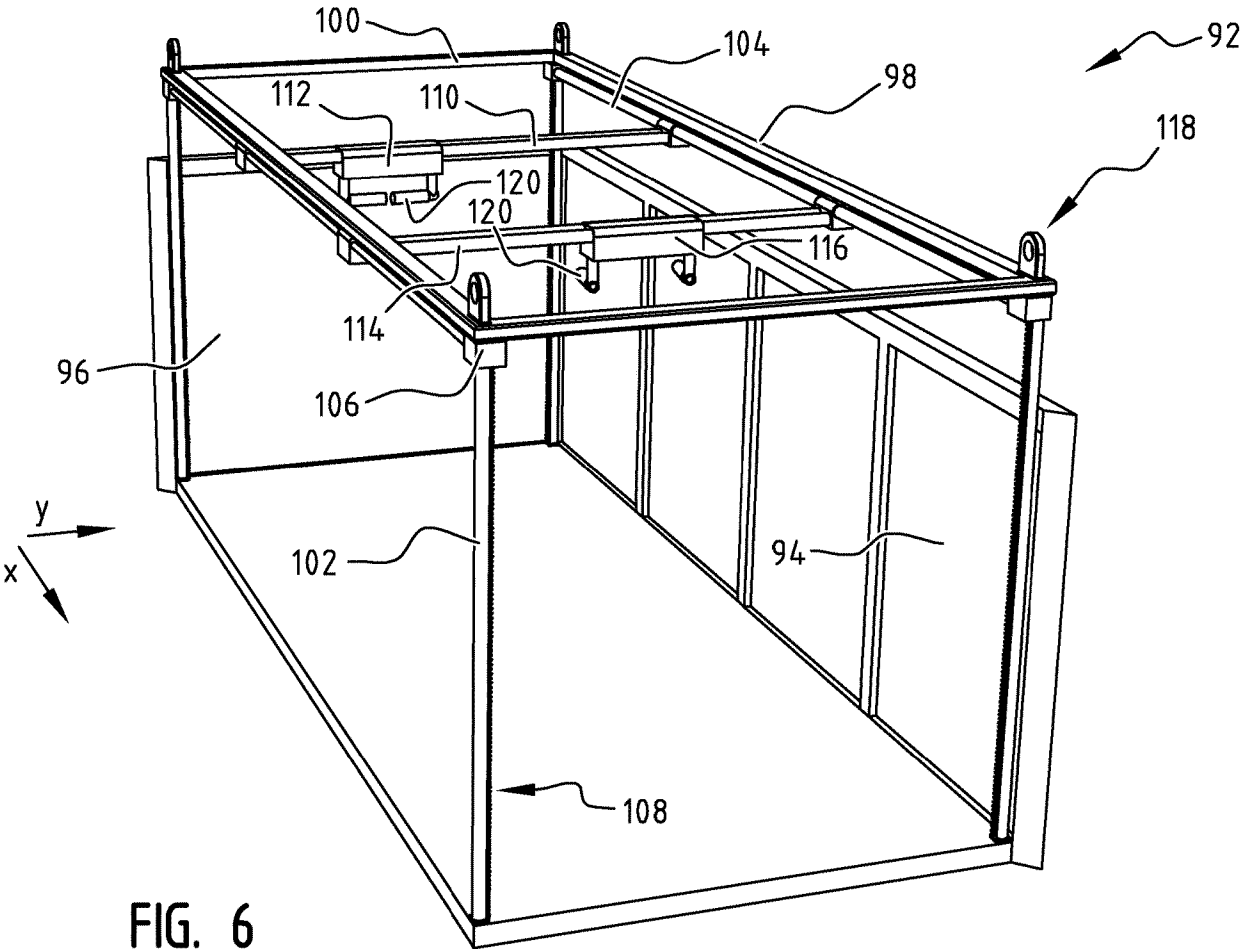
FIGS. 6-9 show views of an alternative embodiment of the invention.
Figure 7:
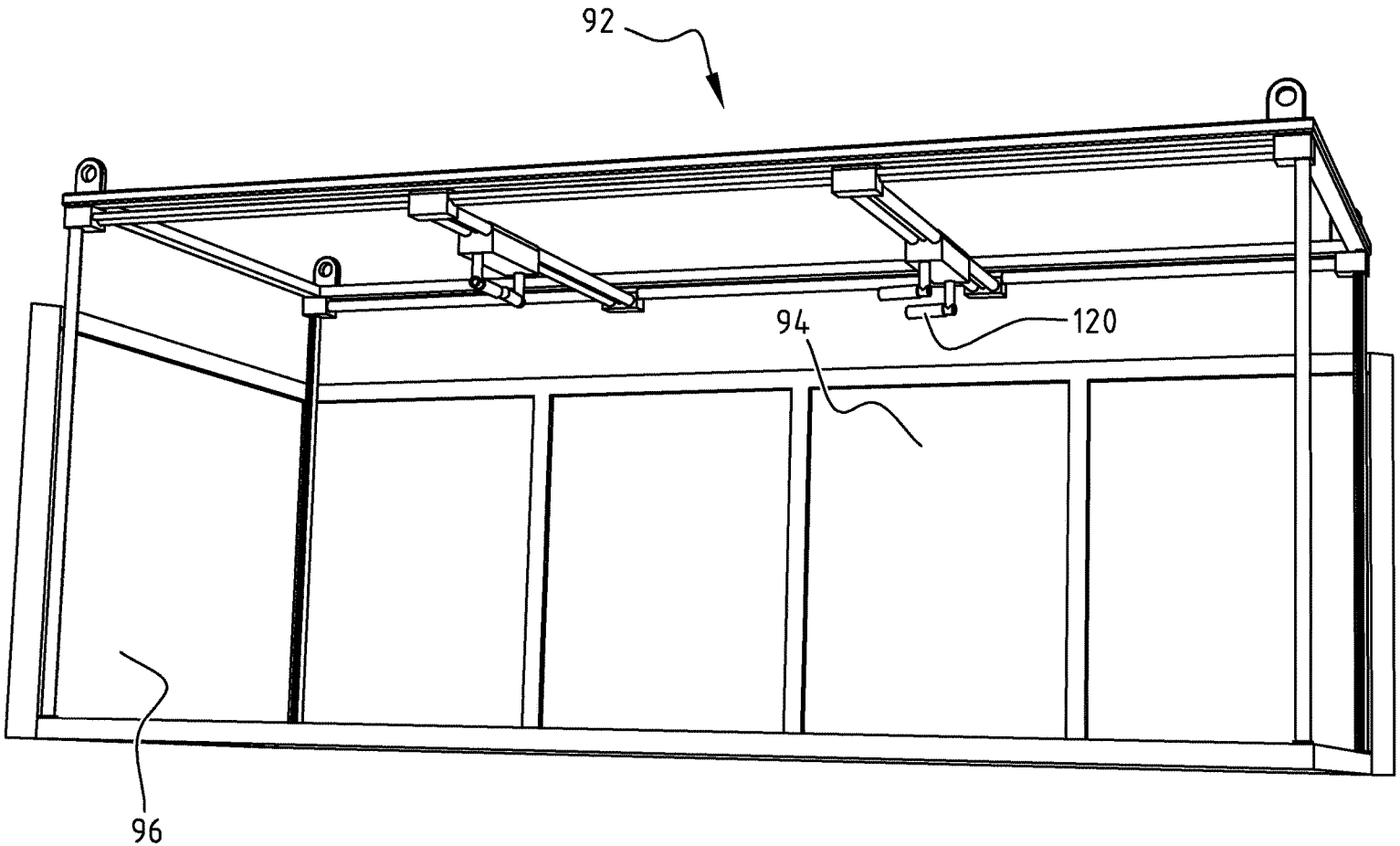
Figure 8:
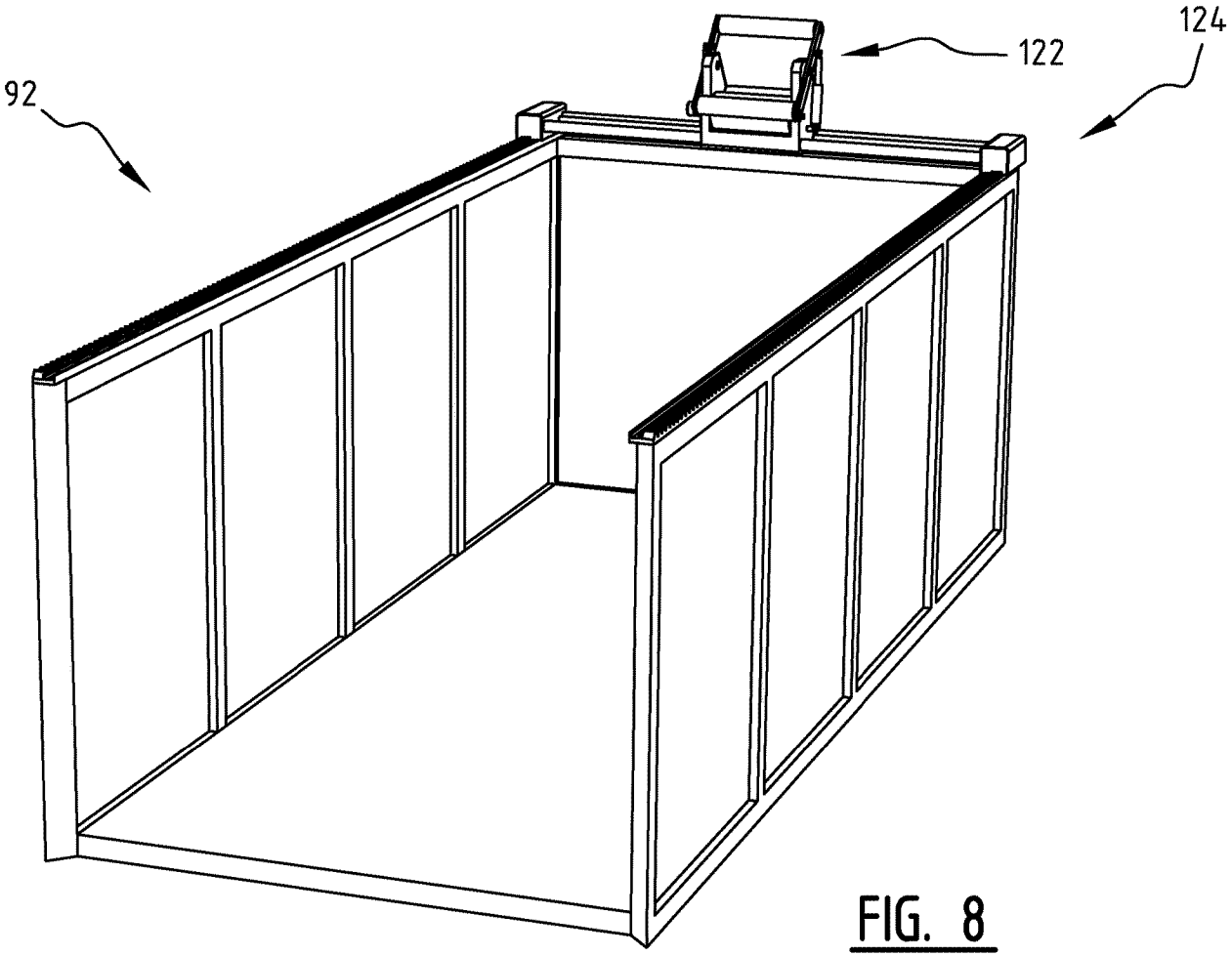
Figure 9:
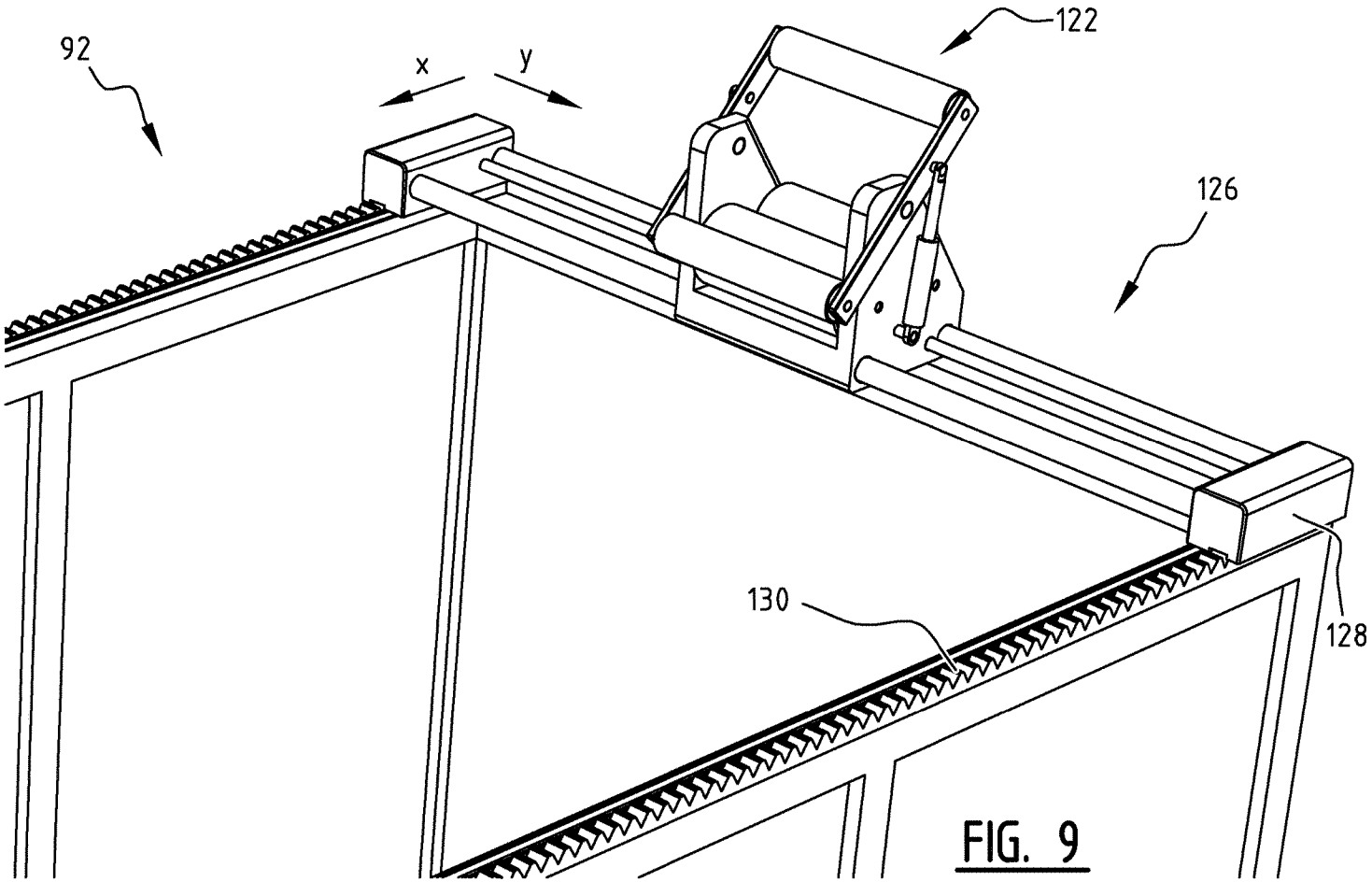

A vehicle 85 (FIG. 5) is substantially the same as vehicle 2 (FIG. 1). Vehicle 85 is additionally provided with a guide 86 and guide means 88, for instance in the form of a carriage, provided movably along guide 86. Device 14 can hereby be displaced, for instance toward a rear side of space 18 to position 14'. In order to ensure that hose 10 is also properly supplied in this rearmost position, one or more separate guide rollers 90 can be provided.

During retraction of a hose, its starting point is fed through retracting device 14. Hose 10 is retracted by then driving drive roller 24, 46, 54, 80, 82. Using the pressing rollers the hose 10 is subsequently pulled upward and emptied, at least to the extent liquid is still present in hose 10. During retraction of hose 10 couplings 30 will also have to be retracted. A mechanism is provided for this purpose with which drive rollers and pressing rollers are moved relative to each other.

In a possible embodiment device 14 is moved over one or more guides 86 in order to set down hose 10 in space 18 in for instance looped manner on stack 20.

A loading space 92 (FIGS. 6-9) is provided with side walls 94, front walls/rear walls 96 and a frame with side beams 98, front beams 100, uprights 102, rails 104 connected to blocks 106 which are height-adjustable using teeth 108 of uprights 102. In the shown embodiment first beam 110 with first guide 112 and second beam 114 with second guide 116 are connected movably to rails 104. First and second guides 112,116 can hereby move in length direction X as well as width direction Y of loading space 92. The frame is further provided with lifting eyes 118. Guides 112,116 are provided with arms or brackets 120, which are optionally displaceable, for the purpose of guiding the hose. In an alternative embodiment retracting device 122 is provided for a frame 124 of loading space 92. Frame 124 is provided with a guide 126 along which retracting device 124 is displaceable in width direction Y, and with blocks 128 which are displaceable in length direction X via teeth 130 on the upper side of side walls 94. A hose can hereby be carried into loading space 92 from both the front and rear of the vehicle.

Tests have shown that a higher retraction speed is achieved in practice. It has thus be found for instance that, under determined conditions, the speed can be increased from one to three km/hour with the retracting device according to the invention. This prevents driving with slipping clutch in the case of a semi-automatic vehicle, thereby causing damage in a semi-automatic vehicle. Owing to the higher speed it is even possible to dispense with a fully automatic vehicle, thereby reducing the cost of retraction.

The present invention is by no means limited to the above described preferred embodiments thereof. The rights sought are defined by the following claims, within the scope of which many modifications can be envisaged.

The invention claimed is:

1. Retracting device for retracting a hose, the device comprising:

a frame;

a drive roller connected to the frame for driving the hose for retraction;

a first pressing element and a second pressing element each operatively connected to the drive roller and suitable for pulling the hose upward in co-action with the drive roller; and displacing means that enables relative movement of the drive roller with respect to each of the first and second pressing elements such that only one of the first and second pressing elements engages with the drive roller at a time during retracting of the hose; and means for displacing the retracting device over or along a guide.

2. Retracting device as claimed in claim 1, wherein the drive roller is displaceable and the first and the second pressing elements are disposed fixedly.

3. Retracting device as claimed in claim 1, wherein the first and the second pressing elements are displaceable and the drive roller is disposed fixedly.

4. Retracting device as claimed in claim 2, wherein the displacing means comprise at least one selected from the group consisting of a rotation mechanism and a translation mechanism.

5. Retracting device as claimed in claim 1, wherein the displacing means displace at least one selected from the group consisting of the drive roller and the first and the second pressing elements such that at least one selected from the group consisting of the drive roller and the first and the second pressing elements co-displace with a moving hose coupling.

6. Retracting device as claimed in claim 1, the retracting device further comprising a detector for detecting a hose coupling.

7. Retracting device as claimed in claim 1, wherein the means for displacing the retracting device over or along a guide comprise:

a guide roller extending substantially in a width direction of the retracting device; and a guide rail for moving the retracting device in a length direction of the retracting device.

8. Retracting device as claimed in claim 1, wherein the retracting device is positioned at an angle relative to a horizontal plane.

9. Vehicle comprising a retracting device for retracting a hose, wherein the retracting device comprises:

a frame;

a drive roller connected to the frame for driving the hose for retraction;

a first pressing element and a second pressing element each operatively connected to the drive roller and suitable for pulling the hose upward in co-action with the drive roller;

displacing means that enables relative movement of the drive roller with respect to each of the first and second pressing elements such that only one of the first and second pressing elements engages with the drive roller at a time during retracting of the hose; and means for displacing the retracting device over or along a guide.

10. Vehicle as claimed in claim 9, the vehicle further comprising a loading space for retracting the hose from a rear side of the vehicle.

11. The vehicle as claimed in claim 9 further comprising a hose guide adapted to guide the hose to the retracting device.

12. A method for retracting a hose, the method comprising:

retracting a hose between a drive roller and each of a first pressing element and a second pressing element so that the hose is engaged between the first pressing element and the drive roller and is not engaged between the second pressing element and the drive roller;

moving one of the drive roller and the first pressing element with respect to the other so that the hose is not engaged between the first pressing element and the drive roller;

moving one of the drive roller and the second pressing element with respect to the other so that the hose is engaged between the second pressing element and the drive roller; and displacing the retracting device over or along a guide;

the hose being engaged by only one of the first pressing element and the second pressing element at a time during retraction of the hose.

13. The method as claimed in claim 12, wherein the moving steps comprise moving the drive roller while the first and second pressing elements remain fixed in place.

14. The method as claimed in claim 12, wherein the moving steps comprise moving the first and second pressing elements while the drive roller remains fixed in place.

15. The method as claimed in claim 12, wherein the drive roller and the first and second pressing elements are disposed in a vehicle and retracting the hose comprises carrying the hose from a rear side of the vehicle into a loading space of the vehicle.

16. The method as claimed in claim 12, further comprising detecting a hose coupling prior to the moving steps and performing the moving steps in response to the detecting step.

17. A hose retracting device comprising:

a drive roller;

a first pressing element;

a second pressing element;

a rotation mechanism and/or a translation mechanism operatively connected to the drive roller or to the first and second pressing elements and adapted to provide relative movement between the drive roller and each of the first and second pressing elements such that only one of the first and second pressing elements engages with the drive roller at a time during retraction of the hose; and a guide adapted and configured to guide displacement of the retracting device.

18. The device as claimed in claim 17, wherein the drive roller is fixed in place and the rotation mechanism and/or translation mechanism is adapted to move the first and second pressing elements with respect to the drive roller.

19. The device as claimed in claim 17, wherein the first and second pressing elements are fixed in place and the rotation mechanism and/or translation mechanism is adapted to move the drive roller with respect to each of the first and second pressing elements.

20. The device as claimed in claim 17, further comprising a detector adapted to generate a signal when a hose coupling is detected so that the rotation mechanism and/or a translation mechanism can provide relative movement between the drive roller and each of the first and second pressing elements.

21. The device as claimed in claim 17, wherein the retracting device is positioned at an angle relative to a horizontal plane.

* * * * *